United States Patent [19]

Quinnell

[11] Patent Number: 4,782,743

[45] Date of Patent: Nov. 8, 1988

[54] RIDGE TILE WITH VENTILATING APERTURE

[76] Inventor: Geoffrey C. Quinnell, 32 The Gill, Pembury, Kent, England

[21] Appl. No.: 16,342

[22] Filed: Feb. 19, 1987

[30] Foreign Application Priority Data

Feb. 19, 1986 [GB] United Kingdom ..... 8604054

[51] Int. Cl.[4] ..... F24F 7/02

[52] U.S. Cl. ..... 98/42.21; 52/199

[58] Field of Search ..... 52/199; 98/42.21, 42.2, 98/42.22, 42.23

[56] References Cited

U.S. PATENT DOCUMENTS

| | | | |
|---|---|---|---|
| 2,147,240 | 2/1939 | Calkins | 98/42.21 X |
| 3,086,323 | 4/1963 | Pine | 52/199 X |
| 3,238,862 | 3/1966 | Smith et al. | 98/42.22 |
| 3,241,474 | 3/1966 | Rousey et al. | 98/42.21 |
| 3,311,047 | 3/1967 | Smith et al. | 98/42.21 |
| 3,874,138 | 4/1975 | Storch | 52/199 |
| 4,545,292 | 10/1985 | Inokawa et al. | 98/42.21 |

FOREIGN PATENT DOCUMENTS

| | | | |
|---|---|---|---|
| 3028860 | 2/1982 | Fed. Rep. of Germany | 52/199 |

*Primary Examiner*—Harold Joyce

*Attorney, Agent, or Firm*—Bacon & Thomas

[57] ABSTRACT

A ridge tile assembly comprises a ridge tile having a ventilating aperture. A cap is disposed over the aperture to prevent rain falling in the aperture, while laterally directed openings in the sides of the cap permit ventilation of the roof space. The laterally directed openings are provided with a longitudinally extending baffle member to shield the openings from laterally directed wind and/or rain.

16 Claims, 2 Drawing Sheets

Figure 1:
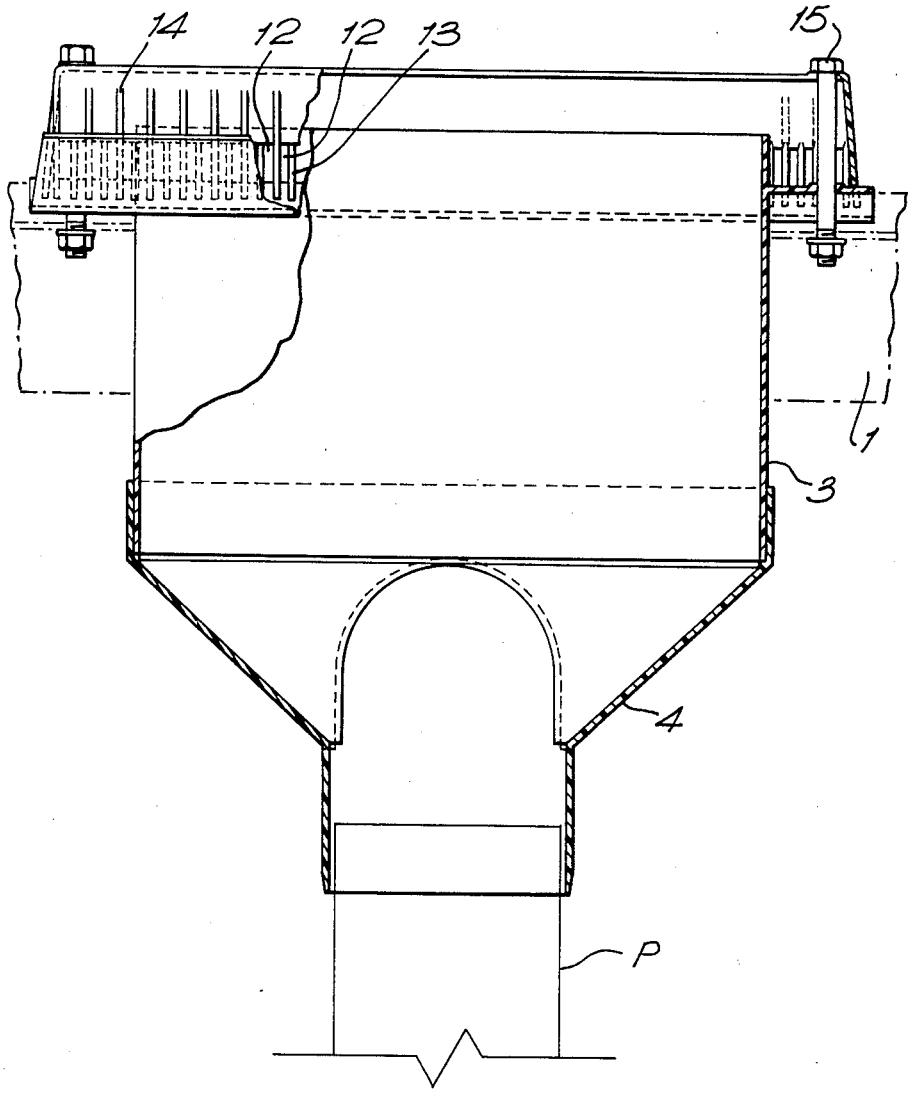

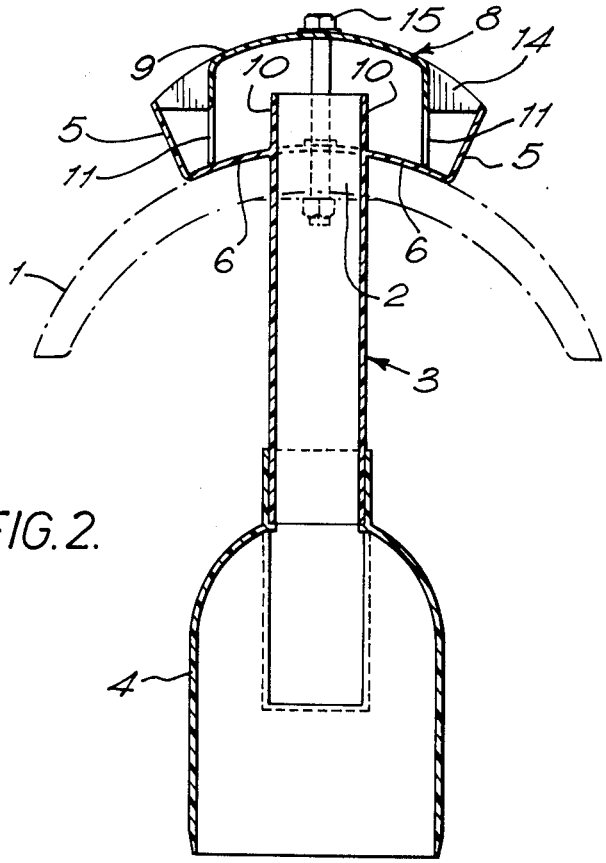
FIG. 2.
FIG. 3.
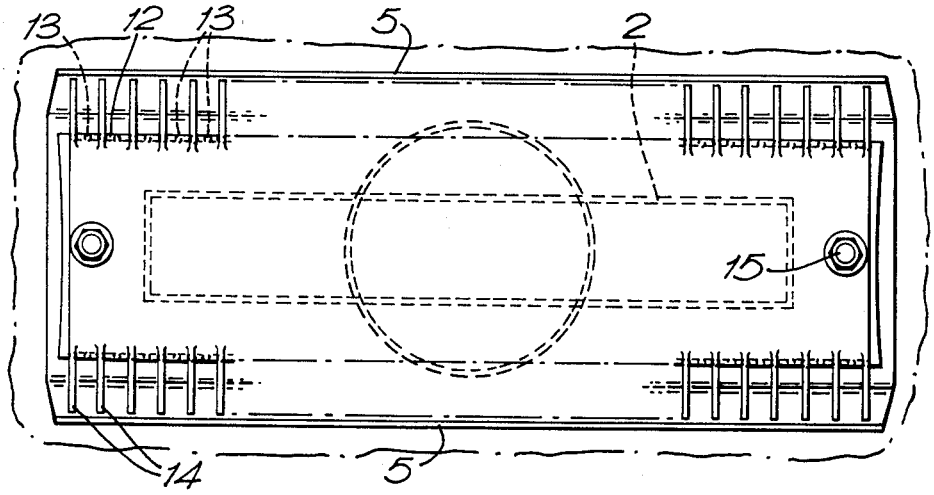

RIDGE TILE WITH VENTILATING APERTURE

This disclosure relates to a ridge tile having a ventilating aperture and in particular, though not exclusively, to such a ridge tile which may be used to provide ventilation of the roof space, or may form the terminal of an extract ventilation system or soil pipe ventilation outlet, or in some cases a flue.

It is a common requirement to provide an aperture in a roof so as to provide ventilation. Typically gas flues and soil pipe outlets are formed simply as pipe vents extending through the roof. These vents, especially in the case of flues from boilers or fires, are often covered by cowls to prevent rainwater, or leaves and similar objects, from entering the pipes. However, these arrangements are not entirely satisfactory for several reasons. They are quite expensive, unsightly and do not work particularly well.

In addition there is known in the prior art a ridge tile having a ventilating aperture which enables the roof space to be ventilated in accordance with the requirements of British standards. This ridge tile includes a slot extending along the length of the tile, and to this slot is connected a ventilation channel leading into the roof space. However, the provision of such a ventilating aperture in a ridge tile presents difficulties in that rain water may enter the roof space by means of the aperture, with the obvious attendant problems. With this difficulty in mind it is known in the prior art to provide the ridge tile ventilation aperture with a cap to prevent rain from reaching the aperture. However, the known design of such a cap does not provide adequate protection against rain which is blown in from either side by the wind. Furthermore the cap has the disadvantage that in a strong wind it produces an unpleasant howling noise.

Viewed from one aspect there is herein disclosed a ridge tile assembly comprising a ridge tile having an upwardly directed ventilating aperture therein, a cap disposed over said ventilating aperture, said cap being arranged to prevent rain falling substantially vertically from reaching the aperture and having at least one laterally directed opening communicating the ventilating aperture with the atmosphere, the or each such laterally directed opening being provided with a longitudinally extending baffle member which restricts access to the aperture of laterally directed wind and/or rain.

Viewed from another aspect there is disclosed herein a ridge tile assembly comprising a ridge tile having an upwardly directed longitudinal ventilating aperture therein, a cap disposed over said aperture, said cap comprising a top portion covering said ventilating aperture and depending side walls on either side of said ventilating aperture with laterally directed ventilating slots formed in lower portions of the side walls, and longitudinally extending baffle members adjacent said side walls shielding each said lower portion.

By means of this arrangement, at least in its preferred forms, when a wind is blowing rain towards the tile at an angle to the vertical the baffle members prevent the rain from reaching the aperture and entering the roof space. In addition since access to the aperture of wind is restricted, the noise generated in a strong wind is reduced.

In a preferred form the baffle members are formed integrally with the upper end of a ventilation channel, the ventilation duct extending through the ridge tile aperture so as to connect, via an adaptor if necessary, to a ventilation pipe in the roof space. The upper end of the ventilation duct is preferably extended beyond the upper surface of the ridge tile, so as to provide additional shielding of the ventilation aperture. The baffle members are preferably connected to the ventilation channel by means of web portions having a shape corresponding to the contour of the outer surface of the ridge tile, such as accurate, whereby said web portions may fit flush against the surface of the tile and support the ventilation channel. The baffle members are preferably formed to be upstanding substantially normal to the tile surface when the integral ventilation duct/baffle member unit is fixed in place.

The cap with side walls is preferably a separate unit secured to the ridge tile and/or duct/baffle member unit.

The ridge tile assembly disclosed herein may be used to provide ventilation of the roof space, or alternatively as the outlet of a soil ventilating pipe or the outlet of a mechanical air extraction system. However other similar uses would be apparent to one skilled in the art, such as a flue.

An embodiment of the above and other broad aspects will now be described by way of example with reference to the accompanying drawings in which;

FIG. 1 is a side view, partly in cross-section, of a ridge tile assembly according to one embodiment, FIG. 2 is a sectional view from one end of the embodiment of FIG. 1, and FIG. 3 is a plan view of the embodiment of FIG. 1.

Referring firstly to FIGS. 1 to 3 of the accompanying drawings there is shown a ridge tile assembly comprising a convex ridge tile 1 having a ventilating aperture in the form of an elongate longitudinally extending rectangular slot 2 through which extends a ventilation duct 3 of matching cross-section. The duct 3 is hollow and extends into the roof space. By means of this arrangement ventilation of the roof space is provided which enables gases, fumes and vapours etc-to escape from the roof space through the ventilation slot 2 provided in the ridge tile.

As is shown particularly clearly in FIG. 2 the ventilation duct 3 is formed with two longitudinally extending baffle members in the form of plates 5. Baffle plates 5 are integrally formed with the ventilation duct 3 and connected to the upper end of the ventilation duct by longitudinally extending web portions 6 which have a curvature substantially equivalent to the outer surface of the ridge tile. When the ventilation duct is fitted in place in slot 2 the webs 6 lie flush against the outer surface of the tile with the baffle plates 5 upstanding substantially normal to the surface of the tile. The upper end portion 10 of the ventilation duct extends upwardly beyond the ventilating slot 2.

The web portions also extend longitudinally beyond the ends of the duct 3 where they are interconnected by integral laterally extending portions, so that there is in effect a continuous flange around the duct 3.

To prevent rain-water from entering the roof space via the ventilating slot the ridge tile is provided with a weather cap 8 which covers the slot 2. The weather cap 8 is formed with a cover portion 9 which is located directly above the slot and generally matches the curvature of the ridge tile, and integral depending side portions 11 which extend substantially vertically from both longitudinal edges of the cover portion 9 into the respective gaps between the baffle plates 5 and the upper end 10 of the ventilation channel 3. Each side portion is provided at its lower end with a plurality of slots 12 alternating with legs 13 which rest on the web portions. The slots between the legs enable the vapours being ventilated to escape to the atmosphere but prevent the ingress of large insects and vermin.

The baffle plates 5 restrict access to the ventilating slot 2 of wind or rain water which is blown towards the slot at an angle by a strong wind. The cover portion 9 of the weather cap provides protection against rain that falls substantially vertically. Additionally the ventilating slot is shielded by the upper end portion 10 of the ventilating duct extending beyond the upper surface of the tile, i.e. above slot 2.

In order to prevent leaves and similar debris from falling into the spaces between the baffle plates 5 and side portions 11 of the weather cap 8, or even the ingress of small animals such as mice, above alternate legs 13, on both sides of the cover portion, are provided laterally outwardly extending portions which form fins that reach the upper ends of the baffle plates 5. The upper edges of the fins 14 match the curvature of the cover portion 9, with which they are flush. The fins extend down to the start of the slots 12 and have horizontal bottom edges. The fins 14 form a grid to prevent e.g. leaves from entering the space below. For example any leaves will settle on the grid and be blown off.

The combined assembly of weather cap 8, ventilation duct 3 and ridge tile 1 are fixed together by means of bolts 15, or similar fastening elements, which extend through apertures in the weather cap 8, extensions of the webs 6, and the ridge tile 1 at each end of the ventilating slot 2.

The ventilation duct 3, with its surrounding flange which fits the shape of the ridge tile 1, may be sealed to the ridge tile by a material such as mastic so as to prevent water from seeping underneath and towards the slot.

Although in the above embodiment the ridge tile has been described in the context of providing ventilation of the roof space, other embodiments will also be apparent. For example the ridge tile may form the outlet end of a mechanical air extraction system. Alternatively the ridge tile may form the upper end of a soil pipe ventilation outlet.

FIG. 1 shows a suitable adaptor 4 to convert the ventilation duct 3 to circular pipe. It is an advantage, in such a case to provide a section of flexible ventilation pipe shown generally at P, immediately below adaptor 4 to allow for roof movement during settling and expansion and contraction of internal pipe work.

While the ridge tile itself is preferably made of conventional tiling materials such as concrete, the ventilation duct unit and the weather cap may be made of any desirable materials such as metal or preferably plastic, the components being particularly suitable for injection molding. It will be appreciated however that if the ridge tile forms the outlet of a flue pipe for hot gases plastic may not be suitable and metal would be preferred. Normally however plastic materials are preferred because of the advantages they offer in terms of cost and weight. The complete ridge tile assembly could be enclosed in a concrete cowl, so that the assembly has the same appearance from the ground as other roof fittings. However, the basic assembly is of neat appearance and compact.

Modifications to the specific embodiment and to any broad aspects thereof referred to or suggested herein may be apparent to those skilled in the art and the disclosure hereof is intended to encompass any such modifications.

I claim:

1. A ridge tile assembly comprising:

(a) a ridge tile having an upwardly directed longitudinal ventilating aperture therein, (b) a ventilation duct having a cross-section substantially the same as that of said ventilating aperture and extending through said ventilating aperture so as to connect to a ventilation pipe, (c) a cap disposed over said aperture, said cap comprising a top portion covering said ventilating aperture and depending side walls on either side of said ventilating aperture, (d) means defining laterally directed ventilating slots in lower portions of said depending side walls, and (e) longitudinally extending baffle members adjacent said side walls shielding each said lower portion, said baffle members being formed integrally with said ventilation duct.

2. An assembly as claimed in claim 1 wherein the upper end of said ventilation duct extends beyond the upper surface of said ridge tile so as to provide additional shielding of the ventilation aperture.

3. An assembly as claimed in claim 1 further comprising;

web portions having a shape corresponding to the curvature of the outer surface of the ridge tile and connecting said baffle members to said ventilation duct.

4. An assembly as claimed in claim 1 wherein said baffle members extend substantially normal to the surface of the ridge tile in use.

5. An assembly as claimed in claim 1 further comprising;

an adaptor connecting said ventilation duct to said ventilation pipe.

6. An assembly as claimed in claim 1 further comprising;

fins extending from said cap to said baffle members.

7. An assembly as claimed in claim 8 wherein said fins are formed integrally with said cap.

8. An assembly as claimed in claim 9 further comprising;

a ventilation duct having a cross-section substantially the same as that of said ventilation aperture and extending through said ventilation aperture so as to connect to a ventilation pipe.

9. An assembly as claimed in claim 10 wherein the upper end of said ventilation duct extends beyond the upper surface of said ridge tile so as to provide additional shielding of the ventilation aperture.

10. An assembly as claimed in claim 11 further comprising;

web portions having a shape corresponding to the curvature of the outer surface of the ridge tile and connecting said baffle members to said ventilation duct.

11. A ridge tile assembly comprising a ridge tile having an upwardly directed ventilating aperture therein, a ventilation duct having a cross-section substantially the same as that of said ventilating aperture and extending through said ventilating aperture so as to connect to a ventilation pipe, a cap disposed over said ventilating aperture, said cap being arranged to prevent rain falling substantially vertically from reaching the aperture and having at least one laterally directed opening communicating the ventilating aperture with the atmosphere, the or each such laterally directed opening being provided with a longitudinally extending baffle member formed integrally with said ventilation duct which restricts access to the aperture of laterally directed wind and/or rain.

12. A ridge tile assembly comprising:

(a) a ridge tile having an upwardly directed longitudinal ventilating aperture therein, (b) a cap disposed over said aperture, said cap comprising a top portion covering said ventilating aperture and depending side walls on either side of said ventilating aperture, (c) means defining laterally directed ventilating slots in lower portions of said depending side walls, (d) longitudinally extending baffle members adjacent said side walls shielding each said lower portion, and (e) fins extending between said cap and said baffle members.

13. An assembly as claimed in claim 12 wherein said fins are formed integrally with said cap.

14. An assembly as claimed in claim 13 further comprising:

a ventilation duct having a cross-section substantially the same as that of said ventilating aperture and extending through said ventilating aperture so as to connect to a ventilation pipe.

15. An assembly as claimed in claim 14 wherein the upper end of said ventilation duct extends beyond the upper surface of said ridge tile so as to provide additional shielding of the ventilating aperture.

16. An assembly as claimed in claim 15 further comprising:

web portions having a shape corresponding to the curvature of the outer surface of the ridge tile and connecting said baffle members to said ventilation duct.

* * * * *